United States Patent [19]

Murray, Jr.

[11] Patent Number: 4,777,747

[45] Date of Patent: Oct. 18, 1988

[54] NUMERICAL PRICE DESIGNATING APPARATUS AND METHOD

[75] Inventor: Hugh A. Murray, Jr., Murrysville, Pa.

[73] Assignee: IDL Incorporated, Pittsburgh, Pa.

[21] Appl. No.: 564,501

[22] Filed: Dec. 22, 1983

[51] Int. Cl.[4] ..... G09F 3/04

[52] U.S. Cl. ..... 40/447; 40/450; 40/586

[58] Field of Search ..... 40/447, 450, 486, 488, 40/451

[56] References Cited

U.S. PATENT DOCUMENTS

| | | | |
|---|---|---|---|
| 1,091,335 | 3/1914 | Herrmann | 40/451 |
| 3,008,065 | 11/1961 | Chamberlin | 40/451 |
| 3,096,594 | 7/1963 | Skrobisch | 40/486 |
| 3,323,241 | 6/1967 | Blair et al. | 40/447 |
| 3,458,944 | 8/1969 | Jimenez | 40/447 |
| 4,164,824 | 8/1979 | Nidelkoff | 40/450 |
| 4,223,464 | 9/1980 | Winrow | 40/450 |

FOREIGN PATENT DOCUMENTS

| | | | |
|---|---|---|---|
| 252864 | 6/1926 | United Kingdom | 40/447 |

*Primary Examiner*—Gene Mancene
*Assistant Examiner*—Wenceslao J. Contreras
*Attorney, Agent, or Firm*—Parmelee, Miller, Welsh & Kratz

[57] ABSTRACT

An inexpensive, quick change pricing display on a sign board employs one or more basic numerical arabic figure eight digits of a segmented construction. Each basic numerical eight is made up of designator segments that may have contrasting color with respect to a viewing background of the display or sign. Numerical digits of zero through nine are selectively formed on each basic eight by applying or removing covering strip segments or elements which may be of the same or a different color as the viewing background to selective designator segments of each basic eight in such a manner as to leave exposed or to present color segments that represent the desired numerical digit.

2 Claims, 1 Drawing Sheet

NUMERICAL PRICE DESIGNATING APPARATUS AND METHOD

This invention deals with a quick and efficient means and procedure for changing numerical designations on a sign, board or plaque, such as used for pricing gasoline, etc.

The normal or accepted manner of changing day to day prices, such as on a large exterior sign for a gasoline service station which is employed to indicate to the motorist the price of gasoline, has been to provide a plurality of individual numbers which can be used in a necessary combination to indicate the day's particular price. These numbers are usually rectangular in shape and made of either metal, plastic or other durable backing. Each of the ten digits are printed on individual rectangles that may be as large as two feet by four feet, depending upon the size of the sign and the distance at which it is to be viewable. For a typical pricing indication where, for example, the amount to be displayed is within a range of $1.00 to $1.99, a total of about twenty-one separate numerical digits is required.

Such a sign must have fastening means for the numbers, such as hooks protruding therefrom on which individual numbers may be hung by means of a hole in their upper ends. The furnishing of a complete set of numbers for three or four numbers on a sign is very costly. There has thus been a need for a simplified, less expensive, and easily changed viewing device and method.

It has thus been an object of the invention to provide a relatively simple and inexpensive approach to the abovementioned problem, employing a series of basic numerical numbers on the viewing face of a sign board that can be easily adapted to any suitable digit.

Another object of the invention has been to provide a system or method of changing numerical numbers or digits on a viewing sign board in an effective and easy manner.

A further object of the invention has been to devise a method wherein each of one or more numerical figure eights may be used to selectively provide any suitable number from zero to nine on a viewing surface of a sign.

These and other objects of the invention will appear to those skilled in the art from the illustrated embodiment and the claims.

Figure 10:
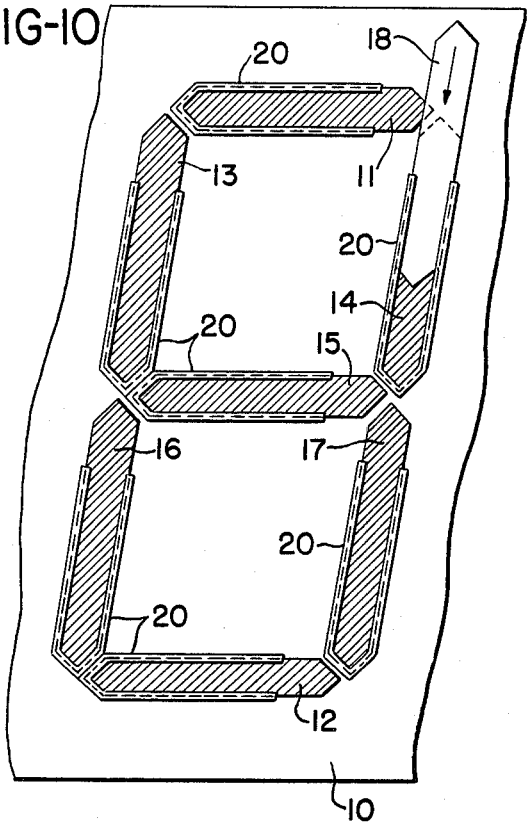
Figure 11:
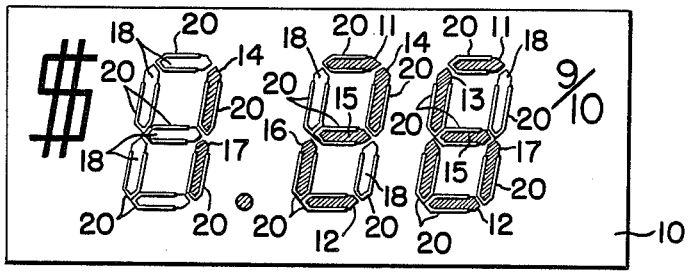

In the drawings, FIGS. 1 through 9, inclusive, are elevational views illustrating in contrasting color how numerical numbers or digits of from one through seven, nine and zero may be formed, employing a basic inscribed numerical FIG. eight, such as illustrated in FIG. 10;

FIG. 10 is an enlarged contrasting color elevation showing a sign board having a basic numerical figure eight that is utilized in selectively forming numbers illustrated in FIGS. 1 through 9, inclusive; it further illustrates how color segments of the figure eight may be selectively covered and thus blocked-out by cover elements having a color corresponding to the background or viewing face of a sign board; and FIG. 11 is a slightly reduced elevation of a typical sign board which has been printed or inscribed with a dollar sign, one inscribed numerical eight to represent the number of dollars, a decimal point, two additional inscribed figure eights to represent cents, and a typical fraction indicator for pricing involved; in this figure, cover elements have been employed to show a per gallon price of $1.26 9/10, by way of example.

Referring to FIG. 10, a fragment of a viewing sign, board or plaque 10 of a suitable representative size and shape, preferably having a planar surface, is shown with a typical numerical figure eight inscribed on or applied thereto to designate one basic number in accordance with the invention. The figure eight inscribed is of a color such as black, brown, etc., as applied on a viewing face having a contrasting color background, such as white, yellow, etc. The eight digit is a permanent part of the sign and a basic element of the invention. Such figure has an opposed, spaced-apart, upper and lower pair of end color segments 11 and 12, an opposed, spaced-apart, upper side pair of color segments 13 and 14, an intermediate cross-extending color segment 15, and a lower opposed, spaced-apart side pair of color segments 16 and 17. As shown, each of the color segments is of a longitudinal bar, polygon or strip-like shape having angular or wedge-shaped opposite ends. The apexes of each color segment are in a spaced-apart, aligned relation with respect to apexes of adjacent color segments.

Each of the seven color segments shown has mounting means 20 for selectively receiving and removably mounting each of a group of cover elements 18 which should be of about six in number for each color segment to provide all necessary numerical indications. Each cover element 18 has a color corresponding to the viewing surface or background of the sign 10 and is of a size and shape substantially corresponding to the size and shape of each color segment. Thus, each of the cover elements 18 may be selectively employed in the manner illustrated in FIGS. 1 through 9, inclusive, to cover various color segments of the basic numerical figure eight to provide numerals of from one through seven, nine and zero. The cover elements 18 may be of wood, metal or plastic of or painted the same color as the viewing surface of the sign board 10. Each cover element 18, as illustrated in FIG. 10, may be removably slid into and mounted in position over a corresponding color segment, such as 14, by means of a U-shaped, edge overlapping, guide rim or flange 20, such as of clear plastic or of metal painted the same color as the viewing face of the board 10. The guide means or rim 20 extends from one end of an associated color segment, such as a bottom end of the color segment 14, and from the apex thereof along opposite sides a major distance to provide a suitable slide "in" and "out" mounting and dismounting of a cover element 18. It will be noted that the ends of each guide means 20 terminate at a spaced distance from the adjacent end of a selected color segment (such as 14) to facilitate a manual grip of a cover element 18 being inserted or removed.

A preferred approach is to provide each cover element 18, alternatively each color segment or both of them, with a pressure-sensitive adhesive under side which is inexpensive, and which as illustrated in FIGS. 1 to 9, inclusive, simplifies application and removal of the cover elements 18. A second alternative is to use magnetic materials.

Figure 1:
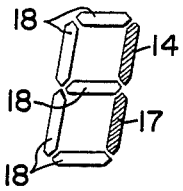
Figure 2:
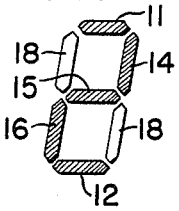
Figure 3:
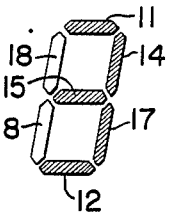

With particular reference to FIGS. 1 through 10, inclusive, FIG. 1 shows the use of five cover elements 18 in forming a numeral one. In this connection, it will be noted that upper and lower end color segments 11 and 12, a cross-extending intermediate color segment 15, as well as left upper and lower side color segments 13 and 16 have been covered. In FIG. 2, the numerical number two has been formed by covering the upper, left hand, side color segment 13 and lower right hand side color segment 17; and in FIG. 3, a numerical 3 has been formed by covering upper and lower left side color segments 13 and 16.

Figure 4:
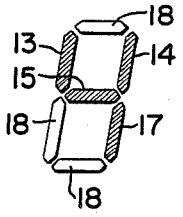
Figure 5:
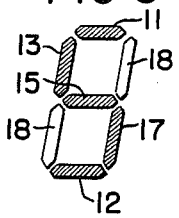
Figure 6:
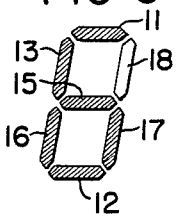
Figure 7:
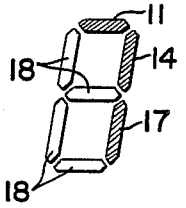
Figure 8:
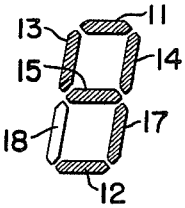
Figure 9:
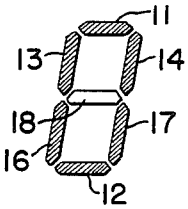

In FIG. 4, a numerical four has been formed by covering the upper and lower end segments 11 and 12 and the left hand lower side segment 16; in FIG. 5, a numerical five has been formed by covering right hand, upper side color segment 14 and left hand, lower side segment 16; and in FIG. 6, a numerical six has been formed by covering the upper, right hand side color segment 14. In a like manner, a numeral seven is formed in FIG. 7 by covering upper and lower left side color segments 13 and 16, intermediate color segment 15, and a lower end color segment 12; in FIG. 9, a numerical nine has been formed by covering left hand, lower side color segment 16; and in FIG. 10, a numerical zero has been formed by covering intermediate, cross-extending color segment 15.

It will be apparent from the above that any suitable pricing may be easily accomplished in a simple and inexpensive manner by employing one or more basic numeral figure eights on the viewing surface of the sign, and selectively mounting or inserting cover elements 18 on each eight in such a manner as to attain the desired numerical figure. It will also be apparent that only five cover elements 18 need be provided for each basic eight; these are inexpensive and can be easily replaced if lost. The cover elements 18, in themselves, have no numbers and do not require sorting before use, such as occurs where, in a system such as previously used, a complete set of individual numbers has to be provided for each digit of the sign.

Although I have shown what is believed to be a preferable method of removably mounting cover elements 18, as illustrated in FIG. 10 of the drawings, it will be apparent that the cover elements 18 may have an adhesive side thereon to take the place of the means 20 where, for example, the sign is to be mounted indoors rather than out-of-doors. Also, other suitable means may be used in this connection without departing from the spirit and scope of the invention.

When reference is made to color or designator segments in the specification, abstract and claims, this includes the use of solid, sectioned or outlined segments representing elongated strip-like blocks that are used to form and inscribe at least one numerical arabic figure eight on the viewing face of a price indicating sign board. It will be apparent that a desired number to be displayed for pricing purposes may be either attained by the use of cover elements or segments that correspond in color to the viewing face of the sign board or that are of a different color than the sign board. In the latter case, the basic arabic figure eight will serve as a guide for the application of the cover elements and the cover elements will be applied to the figure in such a manner as to, themselves, display a desired pricing numerical designation or digit.

I claim:

1. A quick, inexpensive and easily changed pricing display assembly which comprises, a substantially planar board having a viewing face portion of a suitable color, a background group assembly of seven like guide segments of a contrasting color with respect to said viewing face portion, each segment being of an elongated strip-like shape of the same length and shape and terminating at its opposite ends in a pair of converging angular edges defining a central apex, each of said color segments being applied to the viewing face portion as guide color segments in a group of seven that define a numerical arabic figure eight of block-like shape; the figure eight arrangement of said color segments being substantially fully symmetrical as defined by opposed spaced-apart substantially horizontally extending top and bottom segments, an intermediate cross-extending substantially horizontally extending segment, and upper and lower pairs of left and right-hand transversely spaced-apart vertically extending segments in an aligned cooperating relation with the horizontally extending segments in which the apexes of terminating ends of each color segment have an aligned relation with respect to the apexes of adjacent terminating ends of other color segments; a loose group of cover elements corresponding in color with said viewing face portion and of substantially the same defined size and shape as said color segments, said cover elements being at at least five in number, and each said cover element having a pressure-sensitive adhesive under side for securely-removably guidably-mounting said cover elements in an aligned face-to-face covering position with respect to selected ones of said color segments to thereby display an arabic number of zero to nine as defined by remaining uncovered color segments.

2. A method of quickly, effectively and efficiently changing numerical pricing designations on a viewing face portion of a gasoline station pricing sign or the like which comprises, inscribing a background block-like arabic numerical figure eight on the viewing face portion in the form of seven symmetrical aligned guide color segments represented by opposed top and bottom horizontally extending color segments, an intermediate horizontally cross-extending color segment, and upper and lower pairs of left and right-hand transversely spaced-apart vertically extending color segments of substantially the same contrasting color with respect to the viewing face portion and in elongated strip-like form, providing a group of cover elements of substantially the same size and shape as the color segments and of substantially the same color as the viewing face portion, providing each of said cover elements with a pressure-sensitive adhesive under side, applying the pressure-sensitive under side of a sufficient number of the cover elements to selectively cover one to five of the color segments defining the figure eight and thereby displaying arabic numbers of zero to nine by remaining uncovered color segments on the figure eight in a contrasting relation on the viewing face portion, employing each color segment as a guide for selectively applying a cover element thereon in a face covering relation with respect thereto, and adhesively-removably retaining each applied cover element by its pressure-sensitive under side in a mounted fully covering relation with respect to an associated color segment.

* * * * *